United States Patent [19]

Shiba et al.

[11] 3,948,663

[45] Apr. 6, 1976

[54] MULTI-LAYER COLOR PHOTOGRAPHIC LIGHT-SENSITIVE MATERIAL

[75] Inventors: Keisuke Shiba; Hideki Naito; Nobuo Yamamoto; Masakazu Yoneyama, all of Minami-ashigara, Japan

[73] Assignee: Fuji Photo Film Co., Ltd., Minami-ashigara, Japan

[22] Filed: Aug. 27, 1974

[21] Appl. No.: 501,107

[30] Foreign Application Priority Data

Aug. 27, 1973 Japan ..... 48-95965

[52] U.S. Cl. ..... 96/67; 96/22; 96/55; 96/74; 96/84 R; 96/94 R; 96/114; 96/114.5

[51] Int. Cl.[2] .. G03C 1/76; G03C 7/16; G03C 1/84; G03C 1/38

[58] Field of Search ..... 96/114, 114.5, 69, 67, 96/94 R, 74, 22, 55, 66 R, 84 A

[56] References Cited

UNITED STATES PATENTS

| | | | |
|---|---|---|---|
| 3,666,478 | 5/1972 | Groh et al. | 96/114.5 |
| 3,754,924 | 8/1973 | DeGeest et al. | 96/114.2 |

*Primary Examiner*—David Klein
*Assistant Examiner*—Alfonso T. Suro Pico
*Attorney, Agent, or Firm*—Sughrue, Rothwell, Mion, Zinn & Macpeak

[57] ABSTRACT

A multi-layer color photographic light-sensitive material providing clear and sharp color images of improved color reproduction which comprises a support having thereon at least two hydrophillic colloid layers, at least one of the hydrophillic colloid layers being a light-sensitive silver halide emulsion layer, at least one of the hydrophilic colloid layers containing a basic synthetic polymer and at least one of the hydrophillic colloid layers containing a surface active agent represented by the General Formula (II)

$$^{+}MO_3S^{-}-\underset{}{\overset{CH_2-COOD_1}{\overset{|}{CH}}}-COOD_2 \qquad \text{(II)}$$

wherein $D_1$ and $D_2$ each represents an aliphatic group having 4 to 20 carbon atoms, and M represents a cation; or the General Formula (III)

$$^{+}M'O_3S^{-}-(O)_{b-1}-D_3 \qquad \text{(III)}$$

wherein $D_3$ represents an aliphatic group having 6 to 40 carbon atoms, M′ represents a cation, and b represents 1 or 2.

24 Claims, No Drawings

MULTI-LAYER COLOR PHOTOGRAPHIC LIGHT-SENSITIVE MATERIAL

BACKGROUND OF THE INVENTION

1. Field of the Invention

The present invention relates to a multi-layer color photographic light-sensitive material which can provide color images having improved color reproduction and sharpness, and, more particularly, to a multi-layer color photographic light-sensitive material free from the disadvantages due to the incorporation of a basic polymer which are encountered during production and processing of the mul ti-layer color photographic light-sensitive material.

2. Description of the Prior Art

A multi-layer color photographic light-sensitive material generally comprises a support having thereon at least two hydrophilic colloid layers with at least one of the hydrophilic colloid layers being a light-sensitive silver halide emulsion layer. In typical multi-color photographic light-sensitive materials an antihalation layer (AHL); an emulsion unit sensitive to blue light and containing a yellow color-forming coupler (BL); an emulsion unit sensitive to green light and containing a magenta color-forming coupler (GL); an emulsion unit sensitive to red light and containing a cyan color-forming coupler (RL); a protective layer (PL); a layer for absorbing light of a specific wavelength range in the ultraviolet and visible regions (FL); an intermediate layer (ML); and the like; are provided on a support.

It is well known in the art that a basic polymer can be used together with an acid dye as a mordant therefor in the AHL, FL, ML or PL of a color photographic light-sensitive material, and can be used in an image-receiving layer of a positive type photographic material for a color diffusion transfer process. In such cases, the acid dye is used to prevent irradiation and halation, to filter light of a specific wavelength range, to increase the resistance to a safe-light, to control the printing condition to a positive light-sensitive material, to readily distinguish one surface of a photographic material from the other, or the like.

A color-forming coupler is frequently incorporated in a color photographic light-sensitive material by dispersing a coupler such as a Fischer type coupler having a water-soluble anionic group in a hydrophilic colloid in a micellar form, or a coupler such as an oil-soluble or hydrophobic coupler in a hydrophilic colloid as fine particles using a surface active agent having an anionic group. Other additives such as an oil-soluble or hydrophobic hydroquinone derivative or ultraviolet absorber are also incorporated.

Particular technical difficulties have been encountered when a basic polymer, an acid dye and color-forming coupler or other photographic additives are used together in the hydrophilic colloid layers of a multi-layer color photographic light-sensitive material.

A first disadvantage is that an anionic surface active agent, such as those of an alkylnaphthalene sulfonic acid type or an alkylbenzene sulfonic acid type which are conventionally used for dispersing a photographic additive such as a hydrophobic coupler, tends to interact with the basic polymer resulting in decreasing the basic properties of the polymer with respect to an acid dye.

A second disadvantage is the prevention of uniform coating due to the occurence of a fine deposit arising from the interaction between the anionic surface active agent and the basic mordant.

A third disadvantage is that most basic polymers render it difficult to remove reduced silver by bleaching and fixing (hereinafter designated "silver removing"), in particular when these are used together with a surface active agent or a colorforming coupler, and result in a thiosulfate which is used in a fixing step remaining in a photographic material thereby degrading the color reproduction and fastness of a dye image.

A fourth disadvantage is that the third disadvantage is further promoted where the so-called "DIR-hydroquinone" "ICC-hydroquinone", "DIR-coupler" or "ICC-coupler" is present (Descriptions are given in U.S. Pat. Application Ser. Nos. 467,539, filed May 6, 1974, and 461,087, filed Apr. 15, 1974 with respect to ICC-couplers and ICC-hydroquinones).

SUMMARY OF THE INVENTION

An object of the present invention is generally to remove the above-described disadvantages.

In greater detail, a first object of the present invention is to provide a multi-layer color photographic light-sensitive material which can form a color image of improved color reproduction and sharpness.

A second object of the present invention is to provide a multi-layer color photographic light-sensitive material in which a hydrophilic colloid layer containing a basic polymer as a mordant for an acid dye in order to achieve the first object is formed without decreasing the mordanting function of the polymer, and which is also suitable for use in a high temperature rapid processing.

A third object of the present invention is to provide a multi-layer color photographic light-sensitive material in which a light-sensitive emulsion layer containing a Fischer type color-forming ocupler or a hydrophobic color-forming coupler finely dispersed therein is applied adjacent a hydrophilic colloid layer containing a basic polymer free from difficulties during production of the multi-layer color photographic light-sensitive material.

A fourth object of the present invention is to provide a method of forming a color image using a multi-layer color photographic light-sensitive material containing a basic mordant in combination with a ICC-hydroquinone or a ICC-coupler, in which silver removing can be performed satisfactorily.

A fifth object of the present invention is to provide a multi-layer color photographic light-sensitive material which can form a color image exhibiting good fastness.

These and other objects of the present invention will be apparent from the following detailed disclosure contained herein.

These objects are accomplished by the use of a compound represented by the following General Formula (II) or (III), as an anionic surface active agent.

The multi-layer color photographic light-sensitive material in the present invention comprises a support having thereon at least two hydrophilic colloid layers, at least one of the hydrophilic colloid layers being a light-sensitive silver halide emulsion layer, at least one of the hydrophilic colloid layers containing a basic synthetic polymer and at least one of the hydrophilic colloid layers containing a surface active agent represented by the following General Formula (II)

$$^{+}MO_3S^{-}-\underset{}{\overset{CH_2-COOD_1}{\overset{|}{CH}}}-COOD_2 \qquad (II)$$

wherein $D_1$ and $D_2$ each represents an aliphatic group having 4 to 20 carbon atoms, and M represents a cation; or General Formula (III)

$$^{+}M'O_3S^{-}-(O)_{b-1}-D_3 \qquad (III)$$

wherein $D_3$ represent an aliphatic group having 6 to 40 carbon atoms, M' represents a cation, and b represents 1 or 2.

DETAILED DESCRIPTION OF THE INVENTION

The aliphatic group having 4 to 20 carbon atoms represented by $D_1$ or $D_2$ in the above-described General Formula (II) includes a saturated or unsaturated, straight-chain or branched-chain hydrocarbon group and a group connected to such hydrocarbon group through a nitrogen atom. The hydrocarbon group can be a hydrocarbon group containing only carbon atoms or a group containing carbon, nitrogen or oxygen atoms in the hydrocarbon chain and halogens, particularly, a fluorine atom, on the hydrocarbon chain, e.g., hydrocarbon chains interrupted by an ether bond, a thioether bond, an amino bond, an amido bond, an ester bond, a sulfonyl bond, etc. A preferred carbon chain length range is 4 to 18 carbon atoms. Suitable examples of groups for $D_1$ and $D_2$ include butyl, octyl, dodecyl, octadecyl, $-C_8F_{17}$, $-(CF_2)_8H$, etc.

The aliphatic group having 6 to 40 carbon atoms represented by $D_3$ in the above-described general formula (III) includes a saturated or unsaturated, straight-chain or branched-chain hydrocarbon group and a group containing an ether bond, a thioether bond, an ester bond, an amino bond, an amido bond, a sulfonyl bond, etc., in such hydrocarbon group. A group containing a branched-chain is preferred for $D_3$. And a preferred carbon chain length range is 8 to 30 carbon atoms. Suitable examples of groups for $D_3$ include hexyl, dodecyl, octadecyl, $-C_6F_{13}$, etc. In particular, a group represented by the following General Formula (IV) is useful.

$$-\text{alkylene}-U\begin{matrix}\diagup V_1\\ \diagdown V_2\end{matrix} \qquad (IV)$$

wherein U represents $$-\overset{|}{N}CO-\ ,\ \text{or}\ -\overset{|}{N}-SO_2-,\ \text{or}\ -NH\overset{CH_2COO-}{\overset{|}{C}}HCOO-,$$

and $V_1$ and $V_2$ each represents an alkyl group. A suitable carbon chain length range for the "alkylene" group in General Formula (IV) above is about 1 to 12 carbon atoms and suitable specific examples thereof include ethylene, propylene, butylene, 2-butenylene, etc.

The cation represented by M and M' in the above-described General Formulas (II) and (III) includes a conventional cation such as hydrogen atom, an alkali metal atom, e.g., Na, K, etc., an ammonium (for example, ammonium, tetramethyl ammonium, etc.) group or the like.

Of the surface active agents which can be used in the present invention, those having straight chain alkyl groups for $D_1$ and $D_2$ in the General Formula (II) are particularly preferred.

Specific examples of the compounds represented by the General Formula (II) which can be used in the present invention are illustrated as follows.

(II-1) $NaO_3S-\overset{CH_2-COOC_8H_{17}-n}{\overset{|}{CH}}-COOC_8H_{17}-n$ (II-2) $NaO_3S-\overset{CH_2-COOC_6H_{13}-n}{\overset{|}{CH}}-COOC_6H_{13}-n$ (II-3) $NaO_3S-\overset{CH_2-COOC_8H_{17}-n}{\overset{|}{CH}}-COON(C_4H_9)_2$ (II-4) $NaO_3S-\overset{CH_2-COOCH_2CH(C_2H_5)C_4H_9}{\overset{|}{CH}}-COOCH_2CH(C_2H_5)C_4H_9$ (II-5) $NaO_3S-\overset{CH_2-COOC_{18}H_{37}-n}{\overset{|}{CH}}-COOC_2H_5$ (II-6) $NaO_3S-\overset{CH_2-COOC_{12}H_{25}-n}{\overset{|}{CH}}-COOC_{12}H_{25}-n$ (II-7) $NaO_3S-\overset{CH_2-COOC_6H_{13}-n}{\overset{|}{CH}}-COOC_8H_{17}-n$ (II-8) $NaO_3S-\overset{CH_2-COOCH_2CH_2\overset{CH_3}{\overset{|}{C}}HCH_2C_2H_5}{\overset{|}{CH}}-COOCH_2CH_2\underset{CH_3}{\underset{|}{C}}HCH_2C_2H_5$ (II-9) $NaO_3S-\overset{CH_2-COO(CF_2)_4H}{\overset{|}{CH}}-COO(CF_2)_4H$ Specific examples of the compounds represented by the General Formula (III) which can be used in the present invention as illustrated as follows.

(III -1) $KO_3S-CH_2CH_2\underset{CH_3}{\underset{|}{N}}COC_{17}H_{33}$ (III -2) $KO_3S-CH_2CH_2\underset{C_{12}H_{25}}{\underset{|}{N}}COCH_3$ (III -3) $NaO_3S-CH_2CH_2NH\overset{CH_2COOC_8H_{17}-n}{\diagdown}CHCOOC_8H_{17}-n$ (III -4) $NaO_3S-O-C_{14}H_{29}$ (III -5) $NaO_3S-O-C_{16}H_{33}$ (III -6) $NaO_3S-(CH_2)_3-O-CH_2CH_2-\overset{CH_3}{\overset{|}{N}}-SO_2-C_8F_{17}$ -continued (III -7) $NaO_3S-(CH_2)_3-(OCH_2CH_2)_5-O-CH_2CH_2-\overset{C_3H_7}{\overset{|}{N}}-SO_2-C_8F_{17}$ The basic synthetic polymer which can be used in the present invention comprises a polymer having a nitrogen atom which forms a secondary amino group, at tertiary amino group or an ammonium group in the main chain or a side chain thereof. The polymer suitably includes a homopolymer, a copolymer and a graft polymer. A suitable degree of polymerization ranges from about 20 to 10,000, preferably 50 to 5,000.

A suitable basic synthetic polymer includes the polymer having a recurring unit represented by the following General Formula (Ia).

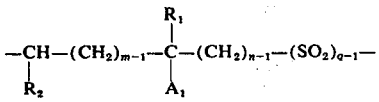

(Ia)

wherein $R_1$ represents a hydrogen atom or an alkyl group having 1 to 6 carbon atoms such as methyl, ethyl, etc.; $R_2$ represents a hydrogen atom, an alkyl group having 1 to 6 carbon atoms such as methyl, ethyl, etc. or an aryl group such as phenyl, tolyl, etc.; m represents 1 or 2; and $A_1$ represents a group having a nitrogen atom which forms a secondary amino group, a tertiary amino group or an ammonium group; and $A_1$ and $R_2$ can combine to form a ring; or the General Formula (Ib)

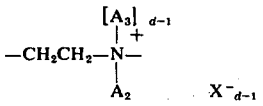

(Ib)

wherein $A_2$ represents a hydrogen atom or a substituted or unsubstituted alkyl group having 1 to 6 carbo atoms (such as methyl, ethyl, etc.); X represents a salt-forming anion; and d represents 1 or 2.

Preferred groups represented by A1 in the General Formula (Ia) are groups represented by the following General Formula (Ic)

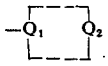

(Ic)

wherein $Q_1$ represents a carbon atom or a nitrogen atom; and $Q_2$ represents the non-metal atoms to form, together with $Q_1$, a 5-membered or a 6-membered heterocyclic ring containing a nitrogen atom which forms a secondary amino group, a tertiary amino group or an ammonium group; or the General Formula (Id)

$$-(Q_3)_{l-1}-Q_4 \qquad \text{(Id)}$$

wherein $Q_3$ represents $-O-R_3-$, $-OCO-R_3-$, $-COO-R_3-$, $-CO-R_3-$,

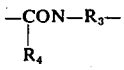

or an arylene group (such as phenylene, etc.); $Q_4$ represents

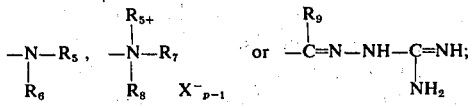

l represents 1 or 2; $R_3$ represents an alkylene group (e.g., having 1 to 6 carbon atoms) or an arylene group (such as phenylene, etc.); $R_4$ represents a hydrogen atom, an alkyl group (e.g., having 1 to 6 carbon atoms, such as methyl, ethyl, etc.), an aryl group (such as phenyl, etc.), or an alkylene group (e.g., having 1 to 6 carbon atoms) connected to $Q_4$; $R_5$ represents an alkyl group (e.g., having 1 to 6 carbon atoms such as methyl, ethyl, butyl, etc.), an aryl group (e.g., such as phenyl) or an aralkyl group (e.g., such as benzyl), $R_6$ represents a hydrogen atom, an alkyl group (e.g., having 1 to 6 carbon atoms such as methyl, ethyl, butyl, etc.), an aryl group (e.g., such as phenyl) or an aralkyl group (e.g., such as benzyl); and $R_6$ and $R_4$ can combine to form a ring; $R_7$ represents a hydrogen atom, an alkyl group (e.g., having 1 to 6 carbon atoms such as methyl, ethyl, butyl, etc.), an aryl group (e.g., such as phenyl) or an aralkyl group (e.g., such as benzyl); $R_8$ represents a hydrogen atom, an alkyl group, (e.g., having 1 to 6 carbon atoms such as methyl, ethyl, butyl, etc.), an aryl group (e.g., such as phenyl), an aralkyl group (e.g., such as benzyl), a carboxyalkyl group (e.g., having 1 to 6 carbon atoms) or a sulfoalkyl group (e.g., having 1 to 6 carbon atoms); $R_9$ represents an alkyl group (e.g., having 1 to 6 carbon atoms such as methyl, ethyl, butyl, etc.); X represents a salt-forming anion; and p represents 1 or 2.

When $A_1$ and $R_2$ combine with $Q_3$ or $Q_4$ in the General Formula (Id) or when $R_4$ and $R_6$ combine in the General Formula (Id), such group can be a group represented by the following general formulas

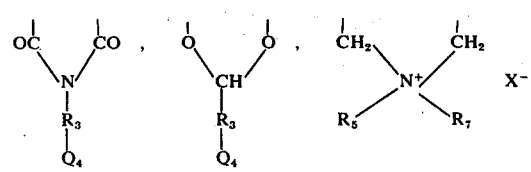

wherein $R_3$, $R_5$, $R_7$, $Q_4$ and X each has the same meaning as defined above.

The non-metal atoms represented by $Q_2$ in the General Formula (Ic) can be selected from a carbon atom, an oxygen atom, a sulfur atom, a selenium atom and a nitrogen atom. Further, the moiety represented by $Q_2$ can be substituted with a substituted or unsubstituted alkyl group (e.g., having 1 to 6 carbon atoms), a substituted or unsubstituted aryl group (e.g., phenyl) or a fused ring. Preferred examples of heterocyclic rings are pyridine, imidazole, pyrozine, pyrrole and the like.

A polymer containing a recurring unit represented by the following General Formula (Ie)

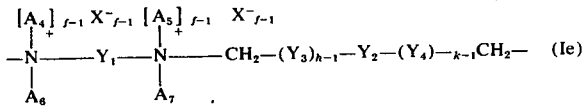

(Ie)

wherein $A_4$, $A_5$, $A_6$ and $A_7$ each represents a lower alkyl group (e.g., having 1 to 6 carbon atoms) or $A_4$ and $A_5$ and/or $A_6$ and $A_7$ can combine to form a nitrogen containing heterocyclic ring (s); $Y_1$ and $Y_2$ each represents an alkylene group, a phenylene group, a xylylene group or a cyclohexylene group, and the alkylene group can contain a double bond, a triple bond, $-SO_2-$ or -O- in the chain thereof; $Y_3$ and $Y_4$ each represents -COO- or

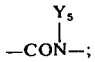

$Y_5$ represents a hydrogen atom or an alkyl group (e.g., having 1 to 6 carbon atoms); X represents a salt-forming anion; and f, h and k each represents 1 or 2.

The anion represented by X in the above-described General Formulas (Ib), (Id) and (Ie) includes a monovalent anion which can form a conventional quaternary salt, such as a halogen ion such as chlorine ion, a perchlorate ion, an acetate ion, a sulfonate ion such as a p-toluene sulfonate ion, a monoalkylsulfate ion, dialkylphosphate ion and the like.

A basic polymer of particular use is the polymer represented by the General Formula (Ia) wherein $R_1$ represents a hydrogen atom or a methyl group; $R_2$ represents a hydrogen atom; *m*, *n* and *q* each represents 1; $A_1$ represents a pyridine or imidazole structure or $-COO-R_3-Q_4$, $-CO-R_3-Q_4$ or $-CONH-R_3-Q_4$; wherein $R_3$ and $Q_4$ each has the same meaning as defined above.

Specific examples of basic polymers which can be used in the present invention and methods of the preparation thereof are described, for example, in British Pat. Nos. 786,592; 906,083; 1,034,044; 1,151,877; 1,161,131; 1,162,214 and 1,261,925; U.S. Pat. Nos. 3,282,699; 3,408,193 and 3,445,231; German Offenlegungsschriften (OLS) 1,803,634; 1,914,361 and 1,914,362; and Japanese Patent Publication No. 10254/68.

Typical examples of recurring units which form the basic synthetic polymer which can be used in the present invention are shown below.

(A)

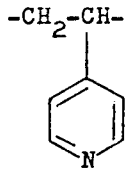

;

(B)

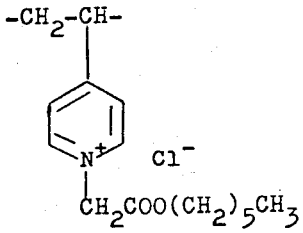

;

(C)

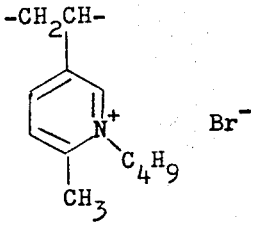

;

(D)

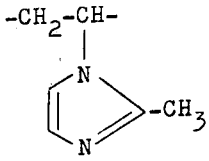

;

(E)

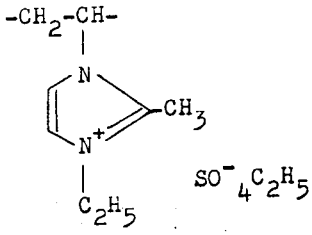

;

(F)

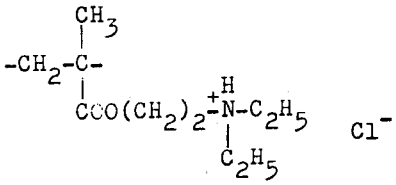

;

(G)

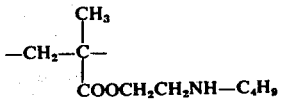

;

(H)

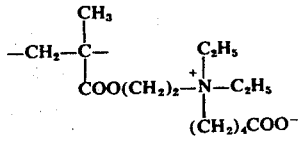

;

-continued
(I)
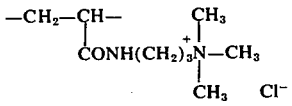
(J)
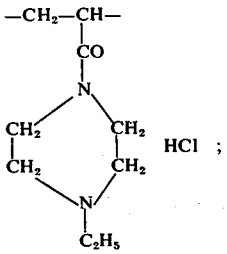
(K)
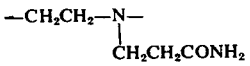
(L)
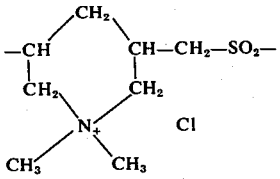
(M)
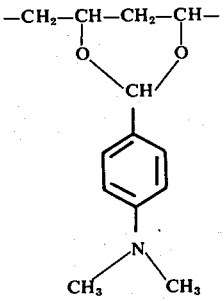
(N)
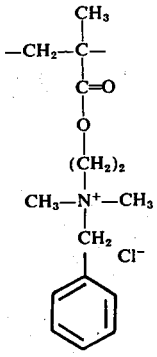
(O)
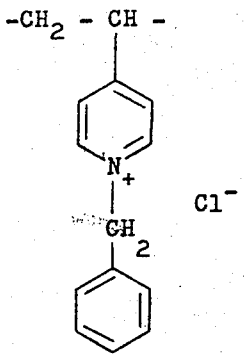
(P)
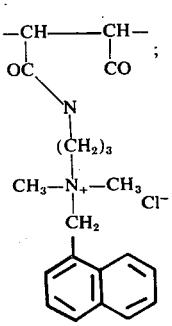
(Q)
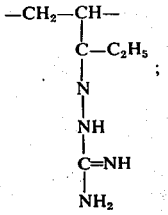
(R)
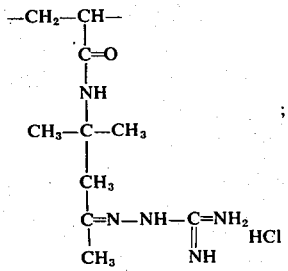
(S)
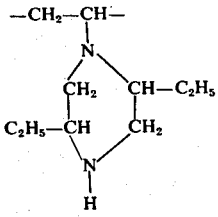
(T)
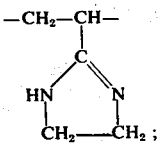
(U)
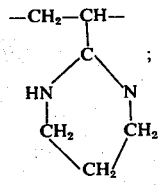
(V)
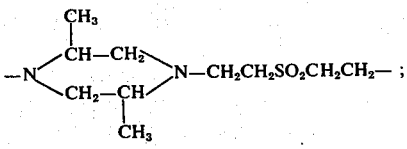
(W)
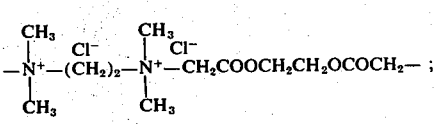

(X)

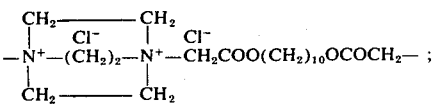

(Y)

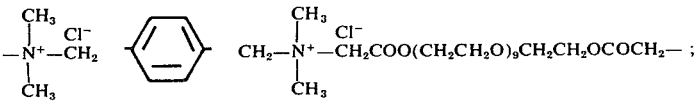

(Z)

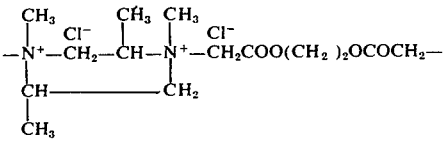

Of the basic polymers which can be used in the present invention, polymers in which about 20 mol% or more of the total recurring units of the above-described recurring unit containing a nitrogen atom which forms a secondary amino group, a tertiary amino group or an ammonium group are preferred. Polymers having 50 mol% or more of the above-described recurring unit are particularly preferred. Suitable monomer units which can form the polymer together with the basic monomer are, for example, methyl acrylate, ethyl acrylate, hydroxyethyl acrylate, butyl acrylate, methyl methacrylate, ethyl methacrylate, hydroxyethyl methacrylate, acrylamide, methacrylamide, N-methylacrylamide, methylolacrylamide, N,N-diethylacrylamide, N-vinyl pyrrolidone, N-vinyl oxazolidone, N-vinyl caprolactam, N-vinyl-N-methyl acetamide, acrylonitrile, vinyl acetate, vinyl propionate, styrene, methyl styrene, methyl vinyl ketone, maleic anhydride, methyl vinyl ether, butadiene, isoprene, chloroprene or the like.

The color-forming couplers which can be used in the present invention include compounds which are capable of forming a dye upon color development with an aromatic primary amino color developing agent such as a phenylenediamine derivative, an aminophenol derivative and the like. Examples of such couplers are 5-pyrazolone couplers, cyanoacetyl cumarone couplers, open-chain acylacetonitrile couplers, acylacetamide couplers (for example, benzoylacetanilide and pivaloylacetanilide couplers), naphthol couplers, phenol couplers and the like.

In greater detail, as magenta color-forming couplers, 5-pyrazolone couplers, cyanoacetyl cumarone couplers, indazolone couplers and the like can be used. Particularly useful couplers are those represented by the following General Formula (IV)

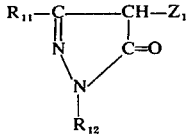

(IV)

wherein $R_{11}$ represents an alkyl group such as a primary, a secondary or a tertiary alkyl group (for example, having 1 to 20 carbon atoms such as methyl, propyl, n-butyl, t-butyl, hexyl, 2-hydroxyethyl, 2-phenylethyl and the like), an alkoxy group (having 1 to 20 carbon atoms such as methoxy, ethoxy, dodecyloxy, octadecyloxy, etc.), an aryl group (such as phenyl, methoxyphenyl, dodecyloxycarbonylphenyl, etc.), a heterocyclic group (for example, quinolinyl, pyridyl, benzofuranyl, oxazolyl and the like), an amino group (for example, methylamino, diethylamino, phenylamino, tolylamino, 4-(3-sulfobenzamino)anilino, 2-chloro-5-acylaminoanilino, 2-chloro-5-alkoxycarbonylanilino, 2-trifluoromethylphenylamino and the like), an amido group (for example, alkylcarbonamido such as ethylcarbonamido, arylcarbonamido, heterocyclic carbonamido such as benzothiazolylcarbonamido, sulfonamido, heterocyclic sulfonamido and the like), or an ureido group (for example, alkyl ureido, aryl ureido, heterocyclic ureido and the like), with each of these groups suitably having 1 to 20 carbon atoms in the alkyl moiety thereof; $R_{12}$ represents an aryl group (for example, naphthyl, phenyl, 2,4,6-trichlorophenyl, 2-chloro-4,6-dimethylphenyl, 2,6-dichloro-4-methoxyphenyl, 4-methylphenyl, 4-acylaminophenyl, 4-alkylaminophenyl, 4-trichloromethylphenyl, 3,5-dibromophenyl and the like), or a heterocyclic group (for example, benzofuranyl, naphthoxazolyl, quinolinyl and the like); and $Z_1$ represents a hydrogen atom or a group which is capable of splitting-off on color development, for example, acyloxy, aryloxy, halogen, thiocyano, substituted amino, aryloxycarbonyloxy, acylamido, alkoxycarbonyloxy, benzotriazolyl, indazolyl, arylazo, heterocyclic azo and the like. Examples of these groups are described in U.S. Pat. Nos. 3,227,550; 3,252,924; 3,311,476 and 3,419,391, German Offenlegungsschrift 2,015,867, and U.S. Pat. Application Ser. No. 471,639, filed May 20, 1974. Also $Z_1$ can be a group which releases a development inhibitor on color development, for example, an arylmonothio group (such as 2-aminophenylthio, 2-hydroxycarbonylphenylthio and the like), a heterocyclic monothio group (such as tetrazolyl, triazinyl, triazolyl, oxazolyl, oxadiazolyl, diazolyl, thiazyl, thiadiazolyl and the like), a heterocyclic imido group (such as 1-benzotriazolyl, 1-indazolyl, 2-benzotriazolyl and the like), etc. Examples of these groups are described in U.S. Pat. Nos. 3,148,062; 3,227,554; 3,615,506 and 3,701,783.

As yellow color-forming couplers, open-chain acylacetamide couplers (for example, pivaloylacetanilide couplers, benzoylacetanilide couplers and the like), open-chain acylacetonitrile couplers and the like can be used. Particularly useful couplers are represented by the following General Formula (V)

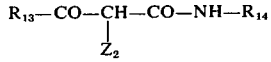

(V)

wherein $R_{13}$ represents an alkyl group such as a primary alkyl, a secondary alkyl or a tertiary alkyl group having 1 to 18 carbon atoms (for example, t-butyl, 1,1-dimethylpropyl, 1,1-dimethyl-1-methoxyphenoxymethyl and the like), or an aryl group (for example, phenyl, alkylphenyl such as 3-methylphenyl, 3-octadecylphenyl, etc., alkoxyphenyl such as 2-methoxyphenyl, 4-methoxyphenyl, etc., halophenyl, 2-halo-5-alkylamidophenyl such as 2-chloro-5-[α-(2,4-di-t-amylphenoxy)-butylamido]phenyl, 2-methoxy-5-alkylamidophenyl, 2-chloro-5-sulfonamidophenyl and the like); $R_{14}$ represents an aryl group (for example, 2-chlorophenyl, a 2-halo-5-alkylamidophenyl such as 2-chloro-5-[α(2,4-di-t-amylphenoxy)acetamido]phenyl, 2-chloro-5-(4-methylphenylsulfonamido)phenyl, 2-methoxy-5-(2,4-di-t-amylphenoxy)-acetamidophenyl and the like; and $Z_2$ represents a hydrogen atom or a group which is capable of splitting off on color development, for example, halogen, in particular fluorine, acyloxy, aryloxy, hetero-aromatic cyclic carbonyl, oxy, sulfimido, alkylsulfoxy, arylsulfoxy, phthalimido, dioxoimidazolidinyl, dioxooxazolidinyl, indazolyl, dioxothiazolidinyl and the like. Examples of these groups are described in U.S. Pat. Nos. 3,227,550; 3,253,924; 3,277,155; 3,265,506; 3,408,194 and 3,415,652; French Patent No. 1,411,384; British Pat. Nos. 944,490, 1,040,710 and 1,118,028; and German Offenlegungsschriften No. 2,057,941; 2,163,812; 2,213,461 and 2,219,971. Also $Z_2$ can be a group which releases a developing inhibitor on color development, for example, an arylmonothio group (such as a phenylthio group, a 2-carboxyphenylthio group and the like), a heterocyclicthio group, a 1-benzotriazole group, a 1-benzodiazole group, and the like, and particularly, the groups described in U.S. Patent Application Ser. No. 454,525, filed Mar. 25, 1974.

As cyan color-forming couplers, naphthol couplers phenol couplers and the like can be used. Particularly useful couplers are represented by the following General Formulas (VI) and (VII)

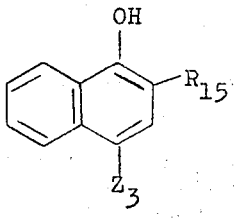

(VI)

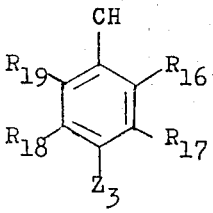

(VII)

wherein $R_{15}$ represents a substituent which can be used in cyan color-forming couplers, for example, a carbamyl group (for example, alkylcarbamyl, arylcarbamyl such as phenylcarbamyl, heterocyclic carbamyl such as benzothiazolylcarbamoyl and the like), a sulfamyl group (for example, alkylsulfamyl, arylsulfamyl such as phenylsulfamyl, heterocyclic sulfamyl and the like), an alkoxycarbonyl group, an aryloxycalbonyl group or the like; $R_{16}$ represents an alkyl group, an aryl group, a heterocyclic group, an amino group (for example, amino, alkylamino, arylamino and the like), a carbonamido group (for example, alkylcarbonamido, arylcarbonamido and the like), a sulfonamido group (for example, alkylsulfonamido, arylsulfonamido and the like), a sulfamyl group (for example, alkylsulfamyl, arylsulfamyl and the like), a carbamyl group (for example alkylcarbamyl, arylcarbamyl and the like) or the like; $R_{17}$, $R_{18}$ and $R_{19}$ represents the group as defined for $R_{16}$, and also a halogen atom, an alkoxy group or the like. Each of $R_{15}$ to $R_{19}$ can contain 1 to 20 carbon atoms in the alkyl moiety thereof. $Z_3$ represents a hydrogen atom or a group which is capable of splitting-off on color development, for example, the groups as defined for $Z_2$. Also $Z_3$ can be a halogen atom such as a chlorine atom, a bromine atom, an iodine atom or the like, indazolyl, cyclicimido, acyloxy, aryloxy, alkoxy, sulfo, arylazo, heterocyclic azo or the like group. Examples of these groups are described in U.S. Pat. Nos. 2,423,730; 3,227,550 and 3,311,476 and British Patent Nos. 1,084,480 and 1,165,563.

The color-forming coupler used in the present invention can be a colored color-forming coupler. Examples of colored couplers are described in U.S. Pat. Nos. 2,983,608; 3,005,712 and 3,034,892; British Patent Nos. 937,621; 1,269,073; 586,211 and 627,814; and French Patent Nos. 980,372; 1,091,903; 1,257,887; 1,398,308 and 2,015,649.

In order to render the color-forming coupler diffusion-resistant, a group containing a hydrophobic group having about 8 to 32 carbon atoms is introduced in the coupler molecule. Such a group is called a ballast group. The ballast group can be connected to the coupler skeleton either directly or through an imino bond, an ether bond, a carbonamido bond, a sulfonamido bond, an ureido bond, an ester bond, an imido bond, a carbamoyl bond, a sulfamoyl bond, or the like.

Typical examples of ballast groups which can be used are illustrated below.

I. Alkyl groups and alkenyl groups for example, $-CH_2-CH(C_2H_5)_2$, $-C_{12}H_{25}$, $-C_{16}H_{33}$, $-C_{17}H_{33}$ II. Alkoxyalkyl groups for example, $-(CH_2)_3-O-(CH_2)_7CH_3$, $$-(CH_2)_3-O-CH_2\underset{\underset{C_2H_5}{|}}{CH}-(CH_2)_8CH_3$$

as described in Japanese Patent Publication No. 27563/64.

III. Alkylaryl groups for example,

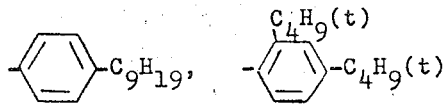

IV. Alkylaryloxyalkyl groups for example,

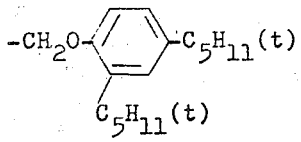

,

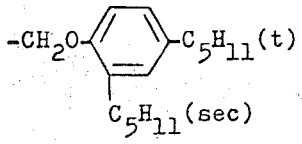

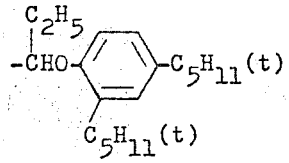

,

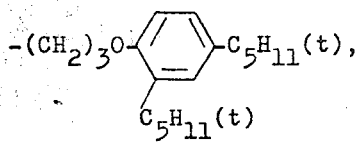

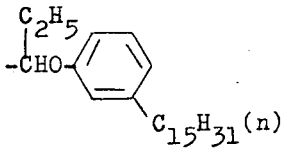

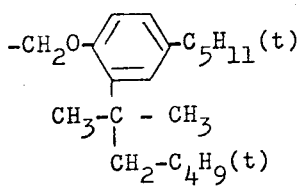

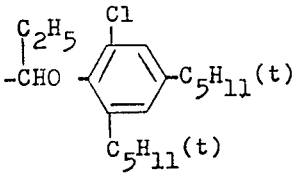

V. Acylamidoalkyl groups for example,

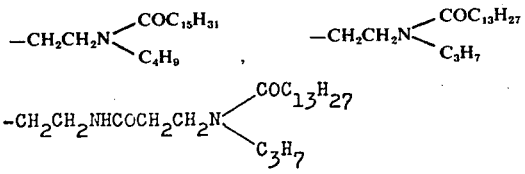

as described in U.S. Pat. Nos. 3,333,344 and 3,418,129.

VI. Alkoxyaryl groups and aryloxyaryl groups for example,

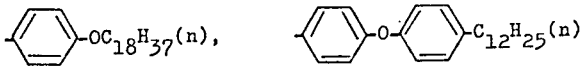

VII. Groups containing a long chain aliphatic group such as an alkyl group and an alkenyl group, and a water-solubilizing group such as a carboxy group or a sulfo group for example,

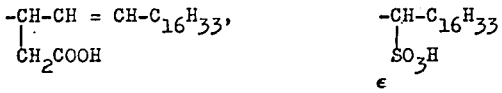

VIII. Alkyl groups substituted with an ester group for example,

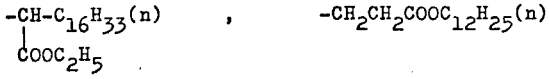

IX. Alkyl groups substituted with an aryl group or a heterocyclic group for example,

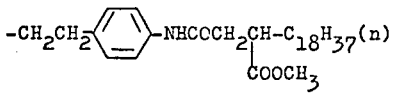

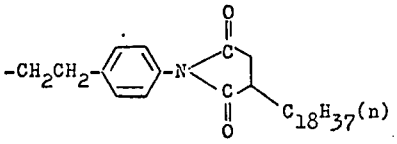

X. Aryl groups substituted with an aryloxyalkoxycarbonyl group for example,

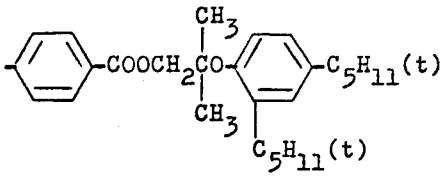

The couplers advantageously used in the present invention are two-equivalent yellow, magenta and cyan couplers, 3-anilino-5-pyrazolone couplers and ICC-couplers.

Specific examples of couplers which can be used in the present invention are shown below, but the present invention is not to be construed as being limited thereto.

Yellow Couplers

1. α-{3-[α-(2,4-Di-tert-amylphenoxy)butyramido]-benzoyl}-2-methoxy-acetanilide
2. α-Acetoxy-α-3-[γ-(2,4-di-tert-amylphenoxy)-butyramido]-benzoyl-2-methoxy acetanilide
3. N-(4-Anisoylacetamidobenzenesulfonyl)-N-benzyl-N-toluidine
4. α-(2,4-Dioxo-5,5-dimethyloxazolidinyl)-α-pivaloyl-2-chloro-5-[α-(2,4-di-tert-amylphenoxy)-butyramido]acetanilide
5. α-(4-carboxyphenoxy)-α-pivaloyl-2-chloro-5-[α-(2,4-di-tert-amylphenoxy)butyramido]acetanilide
6. α-(1-Benzyl-3-hydantoinyl)-α-pivaloyl-2-chloro-5-[α-(2,4-di-tert-amylophenoxy)butyramido]acetanilide
7. α-Benzoyl-α-(2-benzothiazolylthio)-4-[N-(γ-phenylpropyl)-N-(4-tolyl)sulfamyl]acetanilide
8. α-Pivaloyl-α-(5-or 6-bromo-1-benztriazole)-5-[α-(2,4-di-tert-amylphenoxy)propionamido]-2-chloroacetanilide

Magenta Couplers 9. 1-(2,4,6-Trichlorophenyl)-3-[3-(2,4-di-tert-amylphenoxyacetamido)-benzamido]-5-pyrazolone
10. 1-(2,4,6-Trichlorophenyl)-3-{3-[α-(2,4-di-tert-amylphenoxy)acetamido]benzamido}-4-acetoxy-5-pyrazolone
11. 1-(2,4,6-Trichlorophenyl)-3-tridecylamido-4-(4-hydroxyphenyl)-azo-5-pyrazolone
12. 1-(2,4,6-Trichlorophenyl)-3-[(3-tridecanoylamino-6-chloro)anilino]-5-pyrazolone
13. 1-(2,4,6-Trichlorophenyl)-3-(3-tetradecyloxycarbonyl-6-chloro)-anilino-4-(1-naphthylazo)-5-pyrazolone
14. 1-(2,4-Dichloro-6-methoxyphenyl)-3-[(3-tridecanoylamino-6-chloro)anilino]-4-benzyloxycarbonyloxy-5-pyrazolone
15. 1- 4-[γ-(2,4-Di-tert-amylphenoxy)butyramido]-phenyl{-3-piperidinyl-4-(1-phenyl-5-tetrazolylthio)-5-pyrazolone
16. 1-(2,4,6-Trichlorophenyl)-3-{4-[α-(2,4-di-tert-amylphenoxy)butyramido]anilino}-4-(1-phenyl-5-tetrazolylthio)-5-pyrazolone 17. 1-{4-[α-(2,4-Di-tert-amylphenoxy)acetamido]-phenyl}-3-methyl-4-(5- or 6-bromo-1-bentriazolyl)-5-pyrazolone Cyan Couplers 18. 1-Hydroxy-N-[γ-(2,4-di-tert-amylphenoxy)-propyl]-2-naphthamide
19. 1-Hydroxy-4-[2-(2-hexyldecyloxycarbonyl)-phenylazo]-2-[N-(1-naphthyl)]naphthamide
20. 1-Hydroxy-4-chloro-N-[α-(2,4-di-tert-amyl-phenoxy)butyl]-2-naphthamide
21. 5-Methyl-4,6-dichloro-2-[α-(3-n-pentadecyl-phenoxy)butyramido]phenol
22. 1-Hydroxy-4-iodo-N-dodecyl-2-naphthamide
23. 5-Methoxy-2-[α-(3-n-pentadecylphenoxy)-butyramido]-4-(1-phenyl-5-tetrazolylthio)phenol Non-Color Forming Couplers 24. N-[α-(2,4-Di-tert-amylphenoxy)acetyl]-ω-(1-phenyl-5-tetrazolylthio)-m-aminoacetophenone An agent which can prevent the fading of the dye image (such as those described in U.S. Pat. Nos. 3,764,337 and 3,432,300 and German Offenlegungsschrift No. 2,146,668) can also dispersed together with a coupler using a solvent according to the present invention.

An antioxidant which can be used in the present invention includes a phenol or a hydroquinone derivative having an aliphatic group containing 8 or more carbon atoms and precursors thereof, such as those described in U.S. Pat. Nos. 2,336,327; 2,728,659, 2,835,579; and 3,700,453.

A filter dye which can be used in the present invention includes a hydrophilic oxonol dye, a benzotriazole type ultraviolet absorber and a benzophenone type ultraviolet absorber, such as those described in U.S. Pat. Nos. 3,253,921; 3,533,794; 3,794,493; 3,785,827 and 3,707,375.

Also as antioxidant for the dye image, the compounds described in U.S. Pat. Nos. 3,432,300 and 3,764,337 and German Offenlegungsschrift No. 2,146,668 are useful. Particularly preferred antioxidant compounds which can be used to prevent color stains, color mixing, etc., are those represented by the following General Formula (VIII)

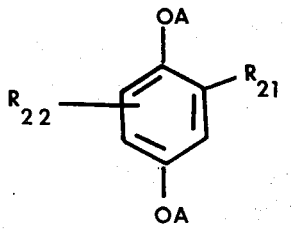

(VIII)

wherein $R_{21}$ represents a straight chain or branched chain alkyl group containing 8 to 20 carbon atoms such as octyl, dodecyl, octadecyl, etc., $R_{22}$ represents a hydrogen atom or a straight chain or branched chain alkyl group containing 1 to 20 carbon atoms such as methyl, ethyl, butyl, octyl, dodecyl, octadecyl, etc.; and A represents a hydrogen atom or a group capable of removal by an alkai (for example, an acetyl group, an alkoxycarbonyl group and the like), where the benzene ring can be further substituted with an alkyl group containing 8 or less carbon atoms, a halogen atom (e.g., chlorine) or the like.

Particularly preferred UV absorber compounds to improve dye image fastness are those compounds represented by the General Formula (IX)

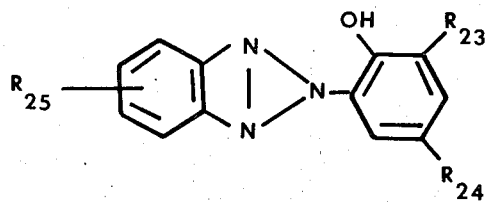

(IX)

wherein $R_{23}$ and $R_{24}$ each represents a hydrogen atom or an alkyl group containing 5 or less carbon atoms (e.g., such as methyl, propyl, t-butyl, etc.); and $R_{25}$ represents a hydrogen atom, an alkoxy group (e.g., having 1 to 6 carbon atoms such as methoxy, etc., or a halogen atom (e.g., such as chlorine and bromine).

Particularly preferred DIR-hydroquinone derivatives which can be used to improve color reproduction include those compounds represented by the General Formula (X)

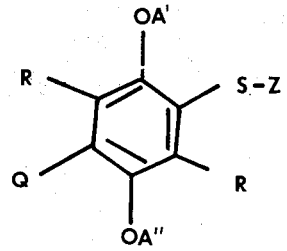

wherein P, Q and R each represents a hydrogen atom, an alkyl group (for example, having 1 to 20 carbon atoms, such as methyl, allyl, ethyl, octyl, tridecyl and the like), a hydroxy group, an alkoxy group (for example, methoxy, ethoxy and the like), an amino group, an alkylthio group (for example, nonylthio, tridecylthio and the like), an arylthio group, an aryl group (for example, phenyl, tolyl and the like), a halogen atom (e.g., such as chlorine and bromine), a heterocyclic group (for example, tetrazolyl, thiazolyl, quinolyl and the like) or an -S-Z group (for example, tetrazolylthio, thiadiazolythio and the like), and P and Q can combine to form a carbon containing ring (e.g., such as a benzene ring, a cyclohexene ring, etc.); A′ and A″ each represents a hydrogen atom or a group capable of removal by an alkali (such as an acyl group, an alkoxycarbonyl group or the like); and Z represents a heterocyclic group which is substantially photographically inert and is removable on development, particularly a hetero-aromatic cyclic group such as a tetrazolyl group (for example, 1-phenyltetrazolyl, 1-alkoxyphenyltetrazolyl and the like), a triazolyl group (for example, 1-phenyl-3-n-amyl-1,2,4-triazolyl and the like), a thiadiazolyl group (for example, 5-methylthiothiadiazolyl, 5-propylthiadiazolyl and the like), an oxazolyl group (for example, 4-methyloxazolyl, benzoxazolyl, α-naphthoxazolyl and the like), an oxadiazolyl group, a thiazolyl group, a pyrimidyl group or the like.

A high-boiling solvent (e.g., boiling above 170°C such as dibutyl phthalate, tricresyl phosphate, acetyl citrate, dioctyl butyl phosphate, diethylhexyl adipate, etc.) which can be used in the present invention can be employed alone or in combination with a substantially water-insoluble low-boiling auxiliary solvent such as methyl acetate, ethyl acetate, butyl acetate or the like, or a water-soluble organic auxiliary solvent such as methyl isobutyl ketone, β-ethoxyethyl acetate, methyl carbitol, methyl cellosolve, dipropylene glycol, dimethylformamide, dioxane or the like. These solvents are described in U.S. Pat. Nos. 2,801,170; 2,801,171; 2,949,360 and 2,835,579. These auxiliary solvents can be removed by washing as described in U.S. Pat. Nos. 2,801,171; 2,949,360 and 3,396,027, or can be removed by evaporation as described in U.S. Pat. Nos. 2,322,027 and 2,801,171 and German Offenlegungsschrift No. 2,045,464.

An acid dye which can be used in the present invention is a water soluble dye containing an anionic water-solubilizing group such as a sulfo group, a carboxylic acid group, a phosphoric acid group, a sulfuric acid group, particularly a sulfo group. As such a dye, an oxonol type dye, a triphenylmethane type dye, an anthraquinone type dye, a benzoquinone type dye, an azo dye and an organometal complex type dye, particularly a dye in which an anionic water-solubilizing group is introduced into the dye skeleton which is known as a sensitizing dye such as those described in F.M Hamer, The Cyanine Dyes and Related Compounds, Interscience Publishers (1964), are useful. For example, a cyanine dye, a merocyanine dye, a complex merocyanine dye, a hemicyanine dye and the like are illustrated. In greater detail, the dyes described in U.S. Pat. Nos. 3,260,601; 3,282,699; 3,294,539; 3,316,091; 3,352,680; 3,379,533; 3,382,074; 3,384,487; 3,389,994; 3,406,069; 3,409,433; 3,417,084; 3,423,207; 2,440,051; 3,468,883; 3,471,293; 3,480,436; 3,485,632; 3,481,927; 3,486,897; 3,493,375; 3,497,502; 3,531,287; 3,540,887; 3,540,888; 3,563,748; 3,560,214; 3,547,640; 3,573,289; 3,576,640; 3,615,546 and 3,615,432; Japanese Patent Publications Nos. 18459/66; 35041/68; 13168/68; 13498/68 and 21766/68; and British Patent Nos. 1,025,567; 1,027,747; 1,030,392; 1,034,044; 1,091,366; 1,112,035; 1,167,026; 1,177,429 and 1,241,692, are useful.

Specific examples of dyes are shown below.

(1)

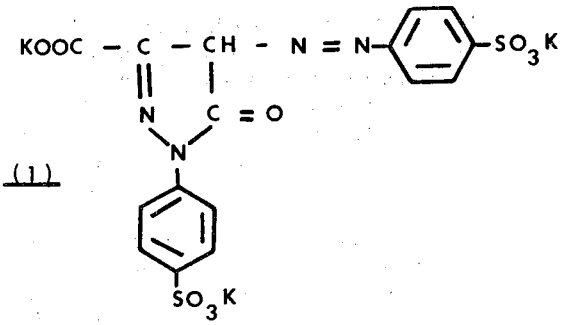

(2)

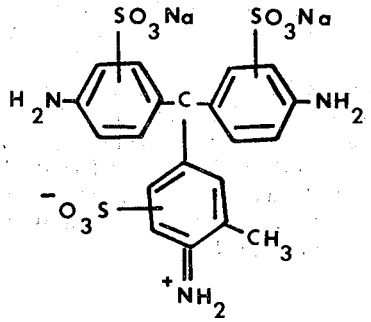

(3)

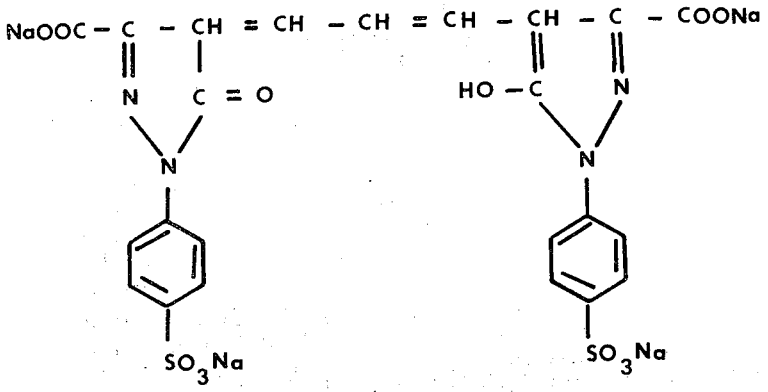

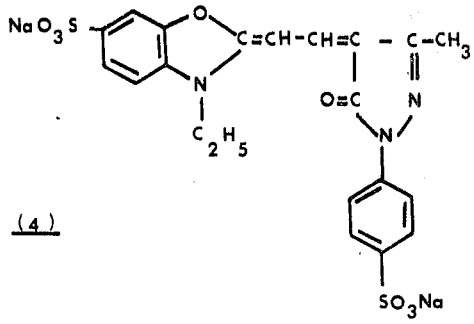

(4)

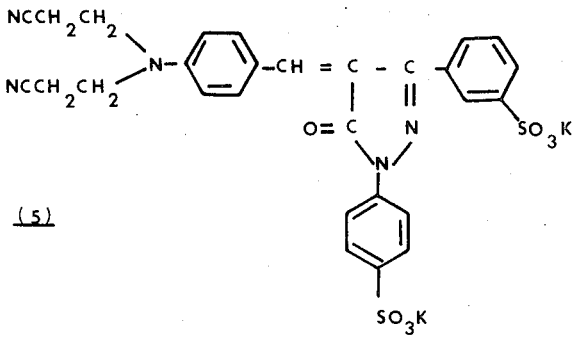

(5)

It is known that an anionic surface active agent, for example, sodium alkylbenzene sulfonate, sodium alkylnaphthalene sulfonate, a Fischer type coupler and the like, an amphoteric surface active agent, for example, N-tetradecyl-N,N-dipolyoxyethylene-$\alpha$-betaine and the like, or a nonionic surface active agent, for example, sorbitan monolaurate, can be used in order to finely disperse a hydrophobic photographic additive such as a coupler, an ultraviolet absorber, a hydroquinone derivative and the like. However, an anionic surface active agent generally tends to desorb and acid dye mordanted by a basic polymer in a colloid layer. On the contrary, the surface active agents according to the present invention have less of this defect or no such defect. Also, the surface active agents can be used satisfactorily to disperse hydrophobic additives such as couplers. Furthermore they are excellent as a coating aid for coating a silver halide emulsion, a gelatin composition containing a colloidal material or a basic mordanting polymer, and the like. It is preferred to use a compound represented by the General Formula (II) in combination with a compound represented by the General Formula (III). For example, when a surface active agent represented by the General Formula (II) is used as a dispersing agent for a hydrophobic additive such as a coupler, and a surface active agent represented by the General Formula (IV) is used as a coating aid, a superior coating can be obtained.

The hydrophilic colloid which can be used in a hydrophilic colloid layer of the present invention includes gelatin, a cellulose derivative, an alginate, a hydrophilic synthetic polymer such as polyvinyl alcohol, polyvinyl pyrrolidone, polystyrene sulfonic acid and the like. The hydrophilic colloid layer can contain a plasticizer for improving the dimensional stability of the photographic material, a polymer latex such as polymethyl methacrylate, polyethylacrylate and the like.

The silver halide emulsion which can be used in the present invention includes a photographic emulsion comprising a silver halide such as silver bromide, silver iodide, silver chloride, or mixtures thereof such as silver chlorobromide, silver iodobromide, silver chloroiodobromide and the like. When at least one emulsion layer of the photographic material contains silver chloroiodide, silver iodobromide or silver chloroiodobromide with an iodide content of about 1 to 10 mol%, particularly preferred results can be obtained. A suitable silver halide particle size ranges from about 0.03 to 2 $\mu$.

To the silver halide emulsion which can be used in the present invention conventionally used chemical sensitizing procedures can be applied. For example, gold sensitization as described in U.S. Pat. Nos. 2,399,083; 2,597,856 and 2,597,915, reduction sensitization as described in U.S. Pat. Nos. 2,487,850 and 2,521,925, sulfur sensitization as described in U.S. Pat. Nos. 1,623,499 and 2,410,689, sensitization with metal ions other than silver as described in U.S. Pat. Nos. 2,448,060; 2,566,245 and 2,566,263, and combinations of the above described methods can be employed. Also the silver halide emulsion which can be used in the present invention can be spectrally sensitized with a sensitizing dye which can be used for spectral sensitization of a color photographic light-sensitive material containing a color-forming coupler such as is disclosed in U.S. Pat. Nos. 2,526,632, 2,503,776, 2,493,748, 3,384,486, 2,933,390, 2,937,089, for example, anhydro-9-methyl-5,5'-dimethyl-3,3'-di(3-sulfopropyl)-benzselenacarbocyanine, 5,5'-dichloro-9-ethyl-di(2-hydroxyethyl)thiacarbocyanine bromide, anhydro-5,5'-diphenyl-9-ethyl-3,3'-di-(2-sulfoethyl)benzoxazolocarbocyanine hydroxide, and the like, either alone or in combination.

The silver halide emulsion which can be used in the present invention can contain a conventionally used additive, for example, a stabilizer such as a 4-hydroxy-1,3,3a,7-tetraazaindene derivative and the like, an antifoggant such as a mercapto compound, a benzotriazole derivative and the like, a coating aid such as saponin, sodium alkylbenzene sulfonic acid and the like, a hardening agent such as formaldehyde, mucobromic acid, 2,4-dichloro-6-hydroxy-s-triazine sodium salt and the like, a wetting agent, a speed increasing agent, for example, an onium derivative such as a quaternary ammonium salt as described in U.S. Pat. Nos. 2,271,623; 2,288,226 and 2,334,864, or a polyalkyleneoxide derivative as described in U.S. Pat. No. 2,708,162; 2,531,832; 2,533,990; 3,210,191 and 3,158,484.

The hydrophilic colloid layer which can be used in the present invention can be applied to various kinds of photographic supports. For example, a cellulose acetate film, a polyethylene terephthalate film, a polyethylene film, a polypropylene film, a glass plate, a baryta coated paper, a resin laminated paper, a synthetic paper and the like can be used. A suitable coating amount of the silver halide ranges from about $5 \times 10^{-4}$ to $5 \times 10^{-1}$ mole (as silver)/m$^2$ of the support, the basic synthetic polymer can suitably be present in an amount of about 1 to 50% by weight of the hydrophilic colloid used and the surface active agent of the formula (II) and (III) in an amount of about 0.02 to 20 g per kilogram of the coating solution.

In forming dye images in the photographic light-sensitive material of the present invention, a developer solution which can reduce silver halide to silver is used. In the case of black and white development, a developer solution containing, as a developing agent, a polyhydroxybenzene, and N-alkylaminophenol, a 1-phenyl-3-pyrazolidone, or a mixture thereof, can be used. Examples of polyhydroxybenzenes include hydroquinone, pyrocatechol, pyrogallol and the like. Examples of N-alkylaminophenols include N-methylaminophenol, N-ethylaminophenol and the like. Examples of 1-phenyl-3-pyrazolidones include 1-phenyl-3-pyrazolidone, 1-phenyl-4,4-dimethyl-3-pyrazolidone and the like. In the case of color development, a developer solution containing, as a developing agent, a para-phenylene diamine derivative such as 4-amino-N,N-diethylaniline, 4-amino-3-methyl-N-methyl-N-(β-methanesulfonamidoethyl)aniline, 4-amino-3-methyl-N-ethyl-N-(β-hydroxyethyl)aniline, 4-hydroxyaniline, 4-hydroxy-2,6-dibromoaniline and the like, can be used.

The photographic light-sensitive material of the present invention can be processed at conventional processing temperatures, e.g., about 20° to 30°C, and also can be processed at higher temperatures, e.g., about 30° to 60°C or higher.

Preferred procedures for processing the color photographic light-sensitive material of the present invention are described in Japanese Patent Publication No. 35749/70 British Patents Nos. 1,293,038; 1,358,615 and 1,387,713, and H. Gordon, The British Journal of Photography, page 558 et.seq. (Nov. 15, 1954), ibid., page 440 et.seq. (Sept. 9, 1955), ibid., page 2 et.seq. Jan. 6, 1956); S. Horwitz, The British Journal of Photography, page 212 et.seq. (Apr. 22, 1960); E. Gehret, The British Journal of Photography, page 122 et.seq. (March 4, 1960), ibid., page 396 et.seq. (May 7, 1965); J. Meech, The British Journal of Photography, page 182 et.seq. (Apr. 3, 1959); German Offenlegungsschrift No. 2,238,051.

Various techniques for removing or reducing the causes or environmental pollution must be used at the processing. First, benzyl alcohol having a development accelerating action which is usually contained in a color developer solution, causes the biological oxygen demand (B O D) to be increased. When a coupler in which a hydroxy group or a carboxylic acid group is introduced in a ballast group or a split-off group (such as $Z_1$, $Z_2$ or $Z_3$ of the above described General Formulas (IV), (V) or (VI) ) is used according to the present invention, a sufficiently high developing rate can be achieved and an excellent color image can be obtained using a color developer solution which does not contain benzyl alcohol. Secondly, ferricyanides or ferrocyanides, which are contained in a bleaching solution for the reduced silver, result in the production of the harmful cyanide ion, and a chelate agent of oxidizable metal salt render the treatment of waste water difficult. In the color photographic light-sensitive material of the present invention, the silver image obtained and reduced silver can be easily bleached. Thus, the color photographic material of the present invention can be advantageously used for preventing pollution.

The color photographic light-sensitive material of the present invention can be bleached with a bleaching solution having an oxidation-reduction potential (E redox) determined by the method as described hereinafter ranging from about −150 mV to 1000 mV and containing a halide ion and a metal salt or an organic oxidizing agent. Examples of metal salts are transition metal salts, particularly salts or complex salts of $Ti^{4+}$, $V^{5+}$, $Cr^{6+}$, $Mn^{7+}$, $Mn^{3+}$, $Cu^{2+}$, $Fe^{3+}$, $Co^{3+}$ and the like.

Examples of organic oxidizing agents are p-sulfophenyl quinone, sulfonaphthoquinone, Bruester Blue radical, Weitz radical and the like. These compounds are described in U.S. Pat. Nos. 2,507,183; 2,529,981; 2,625,477; 2,748,000; 2,810,648 and 2,705,201; British Pat. Nos. 1,111,313; 777,635; 1,032,024; 1,014,396 and 982,984; and Japanese Patent Publication Nos. 14035/70 and 13944/66.

The term "E redox" which is used in the present invention can be defined as the value determined using the following procedure.

The measurement was carried out using a conjugated platinum electrode (EA-216, manufactured by Metrohm Ltd.) equipped with a silver/silver chloride electrode as a reference electrode and a potentiometer (E-436, manufactured by Metrohm Ltd.) at 25°C±0.2°C.

Specific examples of bleaching solutions or bleach-fixing solutions are as follows.

| | |
|---|---|
| Bleaching Solution A | |
| Ferric Chloride (hexahydrate) | 200 g |
| Sodium Chloride | 20 g |
| Sodium Citrate (dihydrate) | 30 g |
| Hydrochloric acid and water were added to adjust the pH to 1.0 and to make the volume 1 liter. | |
| E redox = 730 mV | |
| Bleaching Solution B | |
| (shown in Example 2) | |
| E redox = 410 mV | |
| Bleaching Solution C | |
| Ammonium Bromide | 160 g |
| Aqueous Ammonia (30%) | 23 cc |
| Ferric Salt of Ethylenediamine-tetraacetic Acid | 130 g |
| Glacial Acetic Acid | 13.5 cc |
| Water to make | 1 liter |
| E redox = 170 mV | |

When the color photographic light-sensitive material of the present invention contains an ICC-hydroquinone or an ICC-coupler, silver removing may be occasionally inhibited and silver remains in the photographic material. In such case, a solution having the above-defined oxidation-reduction potential of about 500 to 1000 mV and containing a salt or a complex salt of transition metal, for example, a complex with an organic acid such as citric acid, etc., and a halide ion, can be used as a bleaching solution to obtain preferred results.

Examples of the present invention are illustrated below, but the invention is not intended to be interpreted as being limited to these examples. Unless otherwise indicated, all parts, percents, ratios and the like are by weight.

EXAMPLE 1

A photographic light-sensitive material having on a support an AHL as a first layer, a GL as a second layer and a PL as a third layer was prepared. The compositions of the layers were as follows, and the coating and drying procedures were performed according to methods which are conventionally used by those skilled in the art.

(1) Support

Undercoated cellulose triacetate film (2) First Layer (3.0 μ)

300 cc of a 5 weight% aqueous solution of a basic polymer of the above described recurring unit (F) (degree of polymerization about 150) was added to 1 kg of a 7% aqueous gelatin solution. To the mixture, with stirring, 100 cc of a 10 weight % aqueous solution of the above described acid dye (3), 10 cc of a 2% aqueous solution of 2-hydroxy-4,6-dichloro-S-triazine sodium salt and 10 cc of a 2% aqueous solution of N-tetradecyl-N,N-dimethyl-betaine were added to prepare a coating solution.

(3) Second Layer (4.0 $\mu$)

A mixture of 100 g of the above described magenta colorforming coupler (14), 100 cc of di-n-butyl phthalate as a high boiling solvent, 20 cc of ethyl acetate and 20 cc of a 20% methanol solution of sorbitan monolaurate was heated to 60°C. The solution obtained was added to 1 kg of a 10% aqueous gelatin solution containing 5 g of the above described Compound (II-2) of the present invention and 1 g of phenol, and the mixture was stirred with a homogenizer to prepare Dispersion (1).

To 1 kg of a silverchlorobromide emulsion (chloride content: 5 mol% silver content: 4 mol (kg emulsion) spectrally sensitized with $8 \times 10^{-5}$ mol of anhydro-5,5'-dichloro-9-ethyl-3,3'-di(4-sulfobutyl)benzoxacarbocyanine, 400 g of Dispersion (1) was added. Then 40 cc of a 2% methanol solution of 5-methyl-7-hydroxy-1,3,4,7a-tetrazaindene, 10 cc of a 1% aqueous solution of the above described Compound (III-1) of the present invention and 10 cc of a 2% aqueous solution of 2-hydroxy-4,6-dichloro-S-triazine sodium salt were added and the pH was adjusted to 6.5 to prepare a coating solution.

(4) Third Layer (1.5 $\mu$)

To 1 kg of a 7% aqueous gelatin solution, 10 cc of a 1% aqueous solution of the above described Compound (III-1) of the present invention and 10 cc of a 2% aqueous solution of 2-hydroxy-4,6-dichloro-S-triazine sodium salt were added to prepare a coating solution.

The photographic light-sensitive material was designated Sample A. For comparison, Sample B which was prepared according to the same manner as described for Sample A except that sodiumdodecylbenzene sulfonic acid was used in place of Compounds (II-2) and (III-1) in the second layer, fine precipitates occured in the coated layer and the sample appeared to have a matt surface.

The cross section of each of the samples was examined with an optical microscope (× 500). In Sample A, most parts of the magenta dyes were fixed in the first layer (AHL). On the contrary in Comparison Sample B, the dyes were not fixed in the first layer but diffused throughout all of the layers and absorbed on the fine precipitates which occurred.

EXAMPLE 2

A photographic light-sensitive material having on a support an $AHL_1$ as a first layer, a BL as a second layer, an ML as a third layer, an RL as a fourth layer, an $AHL_2$ as a fifth layer, a $GL_1$ as a sixth layer, a $GL_2$ as a seventh layer, an FL as a eighth layer and a PL as a ninth layer was prepared. The compositions of the layers were as follows.

First Layer ($AHL_1$) : thickness 1.5 $\mu$

To 1 kg of an aqueous gelatin dispersion containing black colloidal silver, 1 g of Compound (III-1) of the present invention was added to prepare a coating solution.

Second Layer (BL) : thickness 3.5 $\mu$

To a silver iodobromide emulsion (iodide content : 6 mol %, silver content : 0.52 mol/kg emulsion), 400 g of a Dispersion (3) described below was added, and the procedures as described in the second layer of Sample A in Example 1 were followed to prepare a coating solution.

Dispersion (3) was prepared according to the method as described for Dispersion (1) but using 95 g of the above described Coupler (4), 5 g of 2-n-octadecylthio-5-(1-phenyltetrazol-5-ylthio)hydroquinone, 150 cc of ethyl acetate and 50 cc of acetyl tri(2-ethylhexyl)citrate.

Third Layer (ML) : thickness 0.7 $\mu$

A gelatin layer containing a dispersion of 2,5-di-tert-octylhydroquinone which was prepared according to the method as described for the third layer of Sample A but using 150 g of Dispersion (4) described below.

Dispersion (4) was prepared by dissolving 100 g of 2,5-di-tert-octylhydroquinone and 0.3 g of 2,3-dihydroxy-naphthalene in 100 cc of butyl acetate, 50 cc of di-n-butyl phthalate and 50 cc of acetyl tributyl citrate, adding the solution of 1 kg of a 10% aqueous gelatin solution, and further adding 5 g of Compound (II-1) and 1 g of phenol, and then stirring the mixture with a homoblender.

Fourth Layer (RL) : thickness 3.0 $\mu$

To 1 kg of a silver iodobromide emulsion (iodide content: 4 mol%, silver content : 0.52 mol/kg emulsion) spectrally sensitized with $2 \times 10^{-5}$ mol of anhydro 5,5'-dichloro-9-ethyl-3,3'-di(3-sulfobutyl)thiacarbocyanine and $1 \times 10^{-5}$ of anhydro-5,5'-dimethyl-9-methyl-3,3'-di(3-sulfopropyl)selenacarbocyanine, 400 g of Dispersion (5) was added, and the procedures as described for the second layer of Sample A were followed to prepare a coating solution.

Dispersion (5) was prepared according to the method as described for Dispersion (1) but using 100 g of the above described Coupler (18), 60 cc of di-n-butyl phthalate and 150 cc of ethyl acetate.

Fifth Layer ($AHL_2$) : thickness 1.0 $\mu$

The same as the first layer of Sample A.

Sixth Layer ($GL_1$) : thickness 2.0 $\mu$

To 1 kg of a silver iodobromide emulsion (iodide content: 4 mol %, silver content : 0.52 mol/kg emulsion) spectrally sensitized with $4 \times 10^{-5}$ mol of anhydro-5,5'-dichloro-9-ethyl-3,3'-di(3-sulfopropyl)oxacarbocyanine and $1 \times 10^{-5}$ mol. of anhydro-5,5',6,6'-tetrachloro-3,3'-di(sulfopropoxyethoxyethyl)benzimidazolocarbocyanine, 400 g of Dispersion (6) was added, and the procedures as described for the second layer of Sample A were followed to prepare a coating solution.

Dispersion (6) was prepared according to the method as described for Dispersion (1) but using 50 g of the above described Coupler (12), 45 g of the above described Coupler (9), 5 g of the above described Coupler (15), 0.5 g of 2-(1,1,3,3-tetramethylbutyl)-5-n-pentadecylthiohydroquinone, 50 cc of acetyl tri-(2-ethylhexyl) citrate and 150 cc of ethyl acetate.

Seventh Layer ($GL_2$) : thickness 1.5 $\mu$

To 1 kg of a silver iodobromine emulsion (iodide content: 6 mol %, silver content: 0.6 mol/kg emulsion) spectrally sensitized in the same manner as described in $GL_1$, 200 g of Dispersion (7) was added, and the procedures as described for $GL_1$ were followed to prepare a coating solution.

Dispersion (7) was prepared according to the method as described for Dispersion (6) but using 100 g of the above described Coupler (12) and 0.5 g of 2-(1,1,3,3-tetramethylbutyl)-5-n-pentadecylthiohydroquinone.

Eighth Layer (FL) : thickness 2.0 $\mu$

A coating solution was prepared according to the method as described for the first layer of Sample A but using a basic polymer of the above described recurring unit (I), 150 cc of a 5% aqueous solution of acid dye (4) and a dispersion of 2,4-di-tert-butyl-6-(6-chlorobenzotriazol-2-yl)phenol.

Ninth Layer (PL): thickness 2.0 $\mu$

A coating solution was prepared according to the method as described for the third layer of Sample A but using a primitive emulsion (silver content: 0.3 mol/kg emulsion) containing fine grain silver bromide (particle size: below 0.04 $\mu$).

Sample C thus prepared had a smooth surface. It was found (by examination of its cross section with an optical microscope) that the magenta dye and the yellow dye were fixed in the fifth layer ($AHL_2$) and the eighth layer (FL), respectively.

Similar results can be obtained using other compounds according to the present invention in place of the compounds used as dispersing agents or coating aids in Sample C.

On the other hand, in a comparative sample which was prepared using sodium nonylbenzene sulfonate, 1-sulfopropoxy-4-nonylbenzene and Alkanol B (sodium alkylnaphthylene sulfonate, produced by E. I. du Pont de Nemours, and Co.) in place of the compounds according to the present invention, the dyes were not fixed in the fifth layer and the eighth layer, and in addition a reticulation-like unevenness and repellency were observed in the surface.

Sample C was subjected to wedge exposure using a white light source, a green light source, a red light source and a blue light source, or to a slit exposure through a slit of 10 mm × 50 $\mu$, and then processed in the following manner.

| Processing Step | Temperature | Time |
|---|---|---|
| Hardening | 38°C | 1 minute |
| Washing | " | 1 minute |
| First Development | " | 3 minutes |
| Washing | " | 30 seconds |
| Reversal Exposure | uniform exposure of 8000 lux. sec. to emulsion side | |
| Second Development | 38°C | 4 minutes |
| Washing | " | 1 minute |
| Bleaching | " | 1 minute |
| Washing | " | 30 seconds |
| Fixing | " | 1 minute |
| Washing | " | 1 minute |

The compositions of the processing solutions used were as follows:

| | | |
|---|---|---|
| **Hardening Bath** | | |
| Sulfuric Acid (1:1 by volume with water) | 5.4 | cc |
| Sodium Sulfate | 150 | g |
| Sodium Acetate | 20 | g |
| Pyruvaldehyde (30% aqueous solution) | 15 | cc |
| Formaldehyde (37% aqueous solution) | 20 | cc |
| Water to make | 1000 | cc |
| **First Developer Solution** | | |
| 4-(N-Methylamino)phenol Sulfate | 2 | g |
| Sodium Sulfite | 90 | g |
| Hydroquinone | 8 | g |
| Sodium Carbonate (monohydrate) | 52.5 | g |
| Potassium Bromide | 5 | g |
| Potassium Thiocyanate | 1 | g |
| Water to make | 1000 | cc |
| **Second Developer Solution** | | |
| Benzyl Alcohol | 5 | cc |
| Sodium Sulfite | 5 | g |
| Hydroxylamine Hydrochloride | 2 | g |
| 4-Amino-3-methyl-N-ethyl-N-($\beta$-methanesulfonamidoethyl)-aniline Sesquisulfate (monohydrate) | 1.5 | g |
| Potassium Bromide | 1 | g |
| Sodium Phosphate | 3 | g |
| Sodium Hydroxide | 0.5 | g |
| Ethylenediamine (70% aqueous solution) | 7 | cc |
| Water to make | 1000 | cc |
| **Bleaching Solution B** | | |
| Potassium Ferricyanide | 100 | g |
| Sodium Acetate | 40 | g |
| Glacial Acetic Acid | 20 | cc |
| Potassium Bromide | 30 | g |
| Water to make | 1000 | cc |
| **Fixing Agent** | | |
| Sodium Thiosulfate | 150 | g |
| Sodium Acetate | 70 | g |
| Sodium Sulfite | 10 | g |
| Potassium Alum | 20 | g |
| Water to make | 1000 | cc |

The color image formed in Sample C showed a excellent clear color hue and an improved sharpness in comparison with that of the comparative sample. A tendency toward insufficient silver removing was somewhat observed in a high yellow density portion of the color image formed in Sample C. But the insufficient silver removing was overcome by using the above described Bleaching Solution A in place of Bleaching Solution B and carrying out the washing after the bleaching for additional 1 minute.

The techniques according to the present invention can be applied not only to a reversal color photographic material suitable for use in a high temperature rapid processing as described in the above Example, but also to a color positive photographic material, particularly a color paper, and a color negative photographic material. The techniques of the invention can also be applied to a color micro photographic material and a color X-ray photographic material. The techniques based on the spirit of the present invention can be further applied to other usages.

While the invention has been described in detail and with reference to specific embodiments thereof, it will be apparent to one skilled in the art that various changes and modifications can be made therein without departing from the spirit and scope thereof.

What is claimed is:

1. A multi-layer color photographic light-sensitive material which comprises a support having thereon at least two hydrophilic colloid layers, at least one of the hydrophilic colloid layers being a light-sensitive silver halide emulsion layer, at least one of the hydrophilic colloid layers containing a basic synthetic polymer and at least one of the hydrophilic colloid layers containing a surface active agent represented by the General Formula (II)

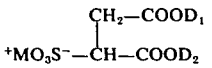

(II)

wherein $D_1$ and $D_2$ each represents an aliphatic group having 4 to 20 carbon atoms; and M represents a cation; or the General Formula (III)

$$^{+}M'O_3S^{-}\text{-}(O)b\text{-}1\text{-}D_3$$

wherein $D_3$ represents an aliphatic group having 6 to 40 carbon atoms; M' represents a cation; and b represents 1 or 2.

2. The multi-layer color photographic light-sensitive material as claimed in claim 1, wherein said surface active agent is a compound represented by the General Formula (II)

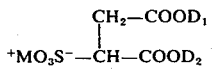

(II)

wherein $D_1$ and $D_2$ each represents an aliphatic group having 4 to 20 carbon atoms; and M represents a cation.

3. The multi-layer color photographic light-sensitive material as claimed in claim 2, wherein said aliphatic group is a saturated or unsaturated, straight-chain or branched-chain hydrocarbon group.

4. The multi-layer color photographic light-sensitive material as claimed in claim 2, wherein said aliphatic group is a a saturated or unsaturated, straight-chain or branched-chain hydrocarbon group connected to the carboxyl through a nitrogen atom.

5. The multi-layer color photographic light-sensitive material as claimed in claim 3, wherein said aliphatic group is an alkyl group.

6. The multi-layer color photographic light-sensitive material as claimed in claim 5, wherein said alkyl group is a straight-chain alkyl group.

7. The multi-layer color photographic light-sensitive material as claimed in claim 1, wherein said surface active agent is a compound represented by the General Formula (III)

$$M'O_3S\text{-}(O)_{b\text{-}1}\text{-}D_3 \qquad \text{(III)}$$

wherein $D_3$ represents an aliphatic group having 6 to 40 carbon atoms; M' represents a cation; and b represents 1 or 2.

8. The multi-layer color photographic light-sensitive material as claimed in claim 7, wherein said aliphatic group is a saturated or unsaturated, straight-chain or branched-chain hydrocarbon group.

9. The multi-layer color photographic light-sensitive material as claimed in claim 7, wherein said aliphatic group is an aliphatic group containing an ester bond, an amino bond, an amido bond, and ether bond, a thioether bond or a sulfonyl bond.

10. The multi-layer color photographic light-sensitive material as claimed in claim 7, wherein said aliphatic group is a branched chain aliphatic group.

11. The multi-layer color photographic light-sensitive material as claimed in claim 7, wherein said aliphatic group is an aliphatic group represented by the following General Formula

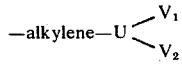

wherein U represents

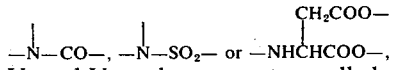

and $V_1$ and $V_2$ each represents an alkyl group.

12. The multi-layer color photographic light-sensitive material as claimed in claim 7, wherein said cation is a hydrogen ion, an alkali metal ion or an ammonium ion.

13. The multi-layer color photographic light-sensitive material as claimed in claim 12, wherein said alkali metal is sodium or potassium.

14. The multi-layer color photographic light-sensitive material as claimed in claim 12, wherein said ammonium ion is an ammonium ion or a tetramethylammonium ion.

15. The multi-layer color photographic light-sensitive material as claimed in claim 1, wherein said basic synthetic polymer is a polymer having a nitrogen atom which forms a secondary amino group, a tertiary amino group or an ammonium group in the main chain or a side chain thereof.

16. The multi-layer color photographic light-sensitive material as claimed in claim 15, wherein said basic synthetic polymer is a polymer having therein a recurring unit represented by the following General Formula (Ia)

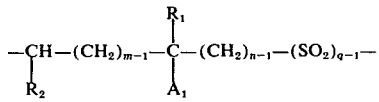

(Ia)

wherein $R_1$ represents a hydrogen atom or an alkyl group having 1 to 6 carbon atoms; $R_2$ represents a hydrogen atom, an alkyl group having 1 to 6 carbon atoms or an aryl group; *m* represents 1 or 2; *n* represents 1 or 2; *q* represents 1 or 2; and $A_1$ represents a group having a nitrogen atom which forms a secondary amino group, a tertiary amino group or an ammonium group; and $A_1$ and $R_2$ can combine to form a ring.

17. The multi-layer color photographic light-sensitive material as claimed in claim 15, wherein said basic synthetic polymer is a polymer having therein a recurring unit represented by the following General Formula (Ib)

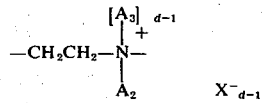

(Ib)

wherein $A_2$ represents a hydrogen atom or an alkyl group; $A_3$ represents a hydrogen atom or an alkyl group; X represents a salt-forming anion; and *d* represents 1 or 2.

18. The multi-layer color photographic light-sensitive material as claimed in claim 16, wherein said group having a nitrogen atom which forms a secondary amino group, a tertiary amino group or an ammonium group is a group represented by the following General Formula (Ic)

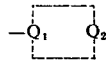

(Ic)

wherein $Q_1$ represents a carbon atom or a nitrogen atom; and $Q_2$ represents the non-metal atoms necessary to form, together with $Q_1$, a 5-membered or a 6-membered heterocyclic group containing a nitrogen atom which forms a secondary amino group, a tertiary amino group or an ammonium group.

19. The multi-layer color photographic light-sensitive material as claimed in claim 16, wherein said group having a nitrogen atom which forms a secondary amino group, a tertiary amino group or an ammonium group is a group represented by the following General Formula (Id)

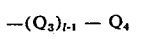

$$-(Q_3)_{l-1}-Q_4 \qquad \text{(Id)}$$

wherein $Q_3$ represents —O—$R_3$—, OCO—$R_3$—, —COO—$R_3$—, —CO—$R_3$—,

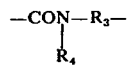

or an arylene group; $Q_4$ represents

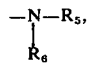

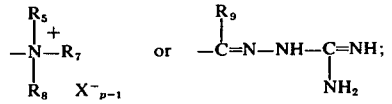

$l$ represents 1 or 2; $R_3$ represents an alkylene group or an arylene group; $R_4$ represents a hydrogen atom, an alkyl group, an aryl group, or an alkylene group connected to $Q_4$; $R_5$ represents an alkyl group, an aryl group or an aralkyl group; $R_6$ represents a hydrogen atom, an alkyl group, an aryl group or an aralkyl group, or $R_6$ can combine with $R_4$ to form a ring; $R_7$ represents a hydrogen atom, an alkyl group, an aryl group or an aralkyl group; $R_8$ represents a hydrogen atom, an alkyl group, an aryl group, an aralkyl group, a carboxyalkyl group or a sulfoalkyl group; $R_9$ represents an alkyl group; X represents a salt-forming anion; and $p$ represents 1 or 2.

20. The multi-layer color photographic light-sensitive material as claimed in claim 16, wherein the ring which is formed by the combination of $A_1$ and $R_2$ is represented by the following General Formula

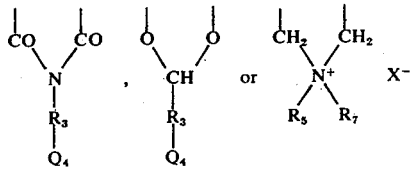

wherein $R_3$ represents an alkylene group or an arylene group; $R_5$ represents an alkyl group, an aryl group or an aralkyl group; $R_7$ represents a hydrogen atom, an alkyl group, an aryl group, or an aralkyl group; $Q_4$ represents

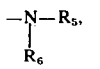

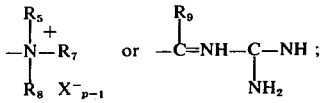

$R_6$ represents a hydrogen atom, an alkyl group, an aryl group or an aralkyl group; $R_8$ represents a hydrogen atom, an alkyl group, an aryl group, a carboxyalkyl group or a sulfoalkyl group; $R_9$ represents an alkyl group; X represents a salt-forming anion; and $p$ represents 1 or 2.

21. The multi-layer color photographic light-sensitive material as claimed in claim 18, wherein said heterocyclic group is a pyridyl group or an imidazolyl group.

22. The multi-layer color photographic light-sensitive material as claimed in claim 15, wherein said basic synthetic polymer is a polymer represented by the following general formula (Ie)

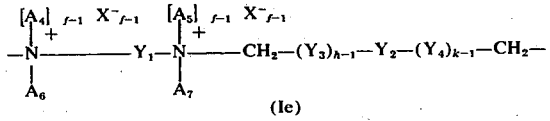

(Ie)

wherein $A_4$, $A_5$, $A_6$ and $A_7$ each represents a lower alkyl group or $A_4$ and $A_5$ and/or $A_6$ and $A_7$ can combine with each other to form a nitrogen containing heterocyclic group; $Y_1$ and $Y_2$ each represents an alkylene group, a phenylene group, a xylylene group or a cyclohexylene group, and said alkylene group can contain a double bond, a triple bond, —$SO_2$— or —O— in the chain thereof; $Y_3$ and $Y_4$ each represents —COO— or

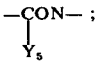

$Y_5$ represents a hydrogen atom or an alkyl group; X represents a salt-forming anion; and $f$, $h$ and $k$ each represents 1 or 2.

23. The multi-layer color photographic light-sensitive material as claimed in claim 16, wherein $R_1$ represents a hydrogen atom or a methyl group; $R_2$ represents a hydrogen atom; $m$, $n$ and $q$ each represents 1; and $A_1$ represents a pyridine group or a imidazole group.

24. The multi-layer color photographic light-sensitive material as claimed in claim 16, wherein $R_1$ represents a hydrogen atom or a methyl group; $R_2$ represents a hydrogen atom; $m$, $n$ and $q$ each represents 1; and A represents —COO—$R_3$—$Q_4$, —CO—$R_3$—$Q_4$ or —CONH—$R_3$—$Q_4$ wherein $R_3$ represents an alkylene group or an arylene group, $Q_4$ represents

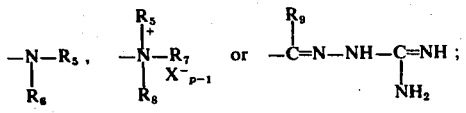

$R_5$ represents an alkyl group, an aryl group or an aralkyl group; $R_6$ represents a hydrogen atom, an alkyl group, an aryl group or an aralkyl group; $R_7$ represents a hydrogen atom, an alkyl group, an aryl group or an aralkyl group; $R_8$ represents a hydrogen atom, an alkyl group, an aryl group, an aralkyl group, a carboxyalkyl group or a sulfoalkyl group; $R_9$ represents an alkyl group; X represents a salt-forming anion; and *p* represents 1 or 2.

* * * * *